US006957986B2

(12) United States Patent
Jing

(10) Patent No.: US 6,957,986 B2
(45) Date of Patent: Oct. 25, 2005

(54) COMPRESSIBLE PIN ASSEMBLY

(75) Inventor: Lu Jing, Wuxi (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/743,938

(22) Filed: Dec. 23, 2003

(65) Prior Publication Data

US 2004/0137800 A1 Jul. 15, 2004

(30) Foreign Application Priority Data

Dec. 24, 2002 (TW) ..... 91220979 U

(51) Int. Cl.[7] ..... H01R 13/24
(52) U.S. Cl. ..... 439/700
(58) Field of Search ..... 439/700, 66, 824, 439/83, 485, 428, 397, 153, 401, 447

(56) References Cited

U.S. PATENT DOCUMENTS 4,050,762 A 9/1977 Hines et al. ..... 339/108 TP
4,397,519 A 8/1983 Cooney ..... 339/255 R
5,387,136 A * 2/1995 Britton ..... 439/668
5,641,315 A 6/1997 Swart et al. ..... 439/824
6,340,320 B1 * 1/2002 Ogawa ..... 439/824
6,559,665 B1 * 5/2003 Barabi ..... 324/755
6,685,492 B2 * 2/2004 Winter et al. ..... 439/219
6,716,043 B2 * 4/2004 Ishizuka ..... 439/131
6,758,682 B1 * 7/2004 Kosmala ..... 439/66
6,773,372 B2 * 8/2004 Matsubara et al. ..... 477/78
6,776,668 B1 * 8/2004 Scyoc et al. ..... 439/700
6,796,850 B2 * 9/2004 Matsui et al. ..... 439/700
2004/0008048 A1 * 1/2004 Florence, Jr. et al. ..... 324/761

* cited by examiner

*Primary Examiner*—P. Austin Bradley
*Assistant Examiner*—Phuongchi Nguyen
(74) *Attorney, Agent, or Firm*—Stephen Z. Weiss

(57) ABSTRACT

A compressible pin assembly includes a barrel, a contact pin and an elastic element. The contact pin is arranged within the barrel. The contact pin has a contact element. The elastic element is arranged within the barrel to bias the contact pin, so that the contact element is flexibly extended out the front end of the barrel. The barrel has aperture formed therein, which allows superfluous gold plating liquid within the barrel to be eliminated smoothly, after the gold plating process. Thus, the barrel will obtain a more uniform and complete electroplated layer with the use of less gold plating liquid. A stopper will then be inserted into the aperture to prevent impurities from entering the hollow chamber of the barrel. This invention will provide a less expensive compressible pin assembly having greater conductivity.

8 Claims, 5 Drawing Sheets

COMPRESSIBLE PIN ASSEMBLY

FIELD OF THE INVENTION

The present invention relates to a compressible pin assembly and, more particularly, to a compressible pin assembly defined as a contact probe for forming an electrical interconnection or providing an electrical contact between two devices.

DESCRIPTION OF THE RELATED ART

With reference to FIG. 1, a conventional compressible pin assembly can be defined as a contact probe for forming an electrical interconnection or providing an electrical contact between two devices. The compressible pin assembly generally includes a barrel 10*a*, a contact element 20*a* and an elastic element 30*a*. The barrel 10*a* is integrally formed by a metallic material and has a hollow chamber. The barrel 10*a* has an open front end and a closed rear end. The elastic element 30*a* and the contact element 20*a* are sequentially placed into the barrel 10*a* from the front end of the barrel 10*a*. Then, the front end of the barrel 10*a* is crimped radially inwardly to form inner dimensions at reduced opening 11*a*. The reduced opening 11*a* keeps the contact element 20*a* and the elastic element 30*a* in the hollow chamber of the barrel while the front end of the contact element 20*a* passes through the reduced opening 11*a*. The elastic element 30*a* pushes against the contact element 20*a* so that the front end of the contact element 20*a* is flexibly extended out the front end of the barrel 10.

In use, the closed rear end of the barrel 10*a* can be fastened and electrically connected to either the same surface of the printed circuit board from which it extends, by means of a surface mount technology (SMT), or to an opposite surface of the printed circuit board, by extending through a hole in the printed circuit board. The front end of the contact element 20*a* can be pressed against a contact of a device that is being tested so that signal of the contact can be transmitted to the printed circuit board for proceeding with the test procedure. The closed rear end of the barrel 10*a* can also be electrically connected to testing equipment while the front end of the contact element 20*a* is pressed against an electrical device, thereby achieving an electrical contact between the testing equipment and the electrical device.

However, the barrel of the conventional compressible pin assembly needs to have better conductivity. To improve conductivity a layer of gold is plated on the barrel. The gold-plating process generally includes the immersion of the barrel in a gold plating liquid. Because the barrel is only opened at its front end, the inner portion of the barrel fails to allow all of the gold plating liquid inside the barrel to easily flow out. This will create a non-uniform electroplated layer at the inner portion of the barrel resulting in a reduction of conductivity and an increased use of the expensive gold liquid.

SUMMARY OF THE INVENTION

It is therefore a principal object of the invention to provide a compressible pin assembly that can enable the superfluous gold plating liquid within the barrel to drain out smoothly. This will reduce the amount of gold plating liquid being used. Furthermore, this will result in a more uniform and complete electroplated layer at the inner portion of the barrel. All of this will result in a compressible pin assembly with better conductivity through the barrel.

To achieve the above object, the present invention provides a compressible pin assembly, which includes a barrel with a hollow chamber, a contact pin, and an elastic element. The barrel has an open front end, a closed rear end, an aperture passing through the barrel, and a stopper designed to be placed in the aperture to seal it after the plating of the barrel has been completed. The pin body of the contact pin is located within the hollow chamber with one end positioned against one end of an elastic element where the other end of the elastic element is forced against the closed rear end of the hollow chamber of the barrel. The elastic element pushes against the pin body so that the end of the contact pin is flexibly extended out the open front end of the barrel.

To provide a further understanding of the invention, the following detailed description illustrates embodiments and examples of the invention, this detailed description being provided only for the illustration of the invention.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
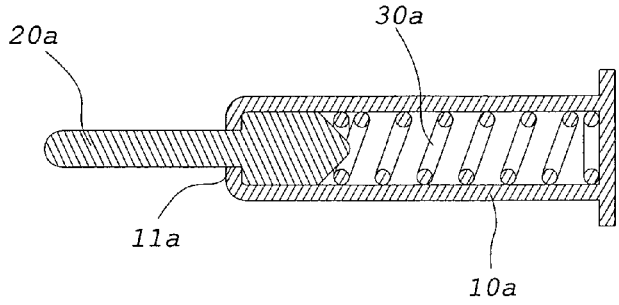
FIG 1 PRIOR ART
FIG. 1 is a cross-sectional view of a compressible pin assembly of the prior art.
Figure 2:
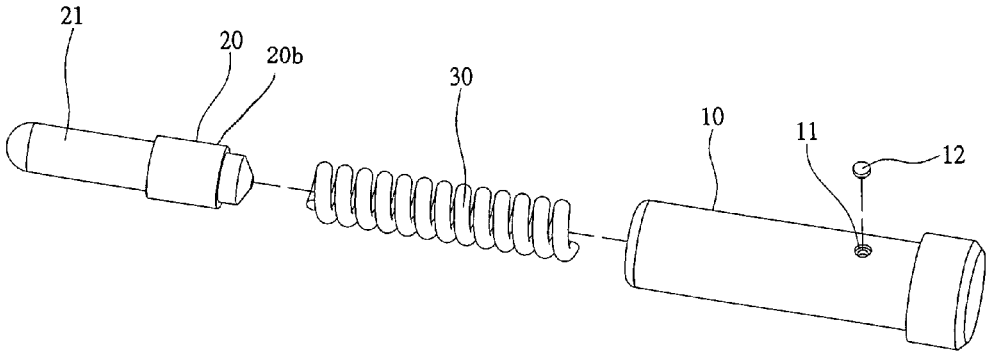
FIG. 2 is a perspective exploded view of a compressible pin assembly in accordance with a first embodiment of the present invention.
Figure 3:
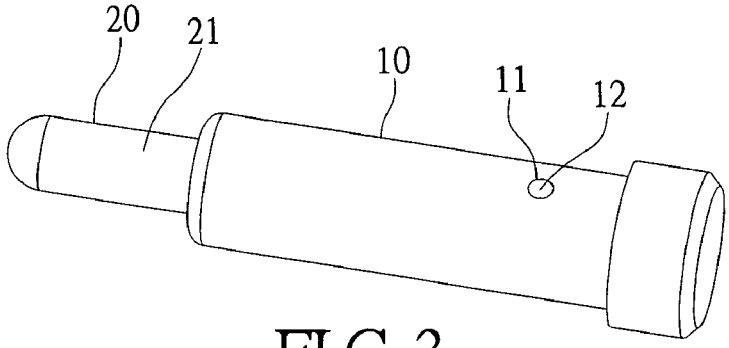
FIG. 3 is a perspective view of the compressible pin assembly in accordance with a first embodiment of the present invention.
Figure 4:
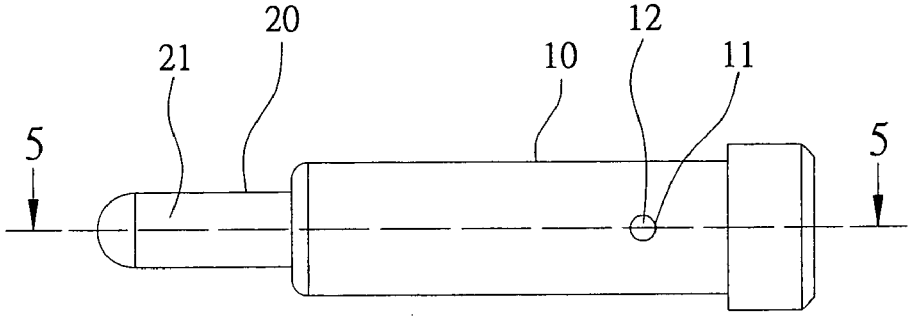
FIG. 4 is a plan view of the compressible pin assembly in accordance with a first embodiment of the present invention.
Figure 5:
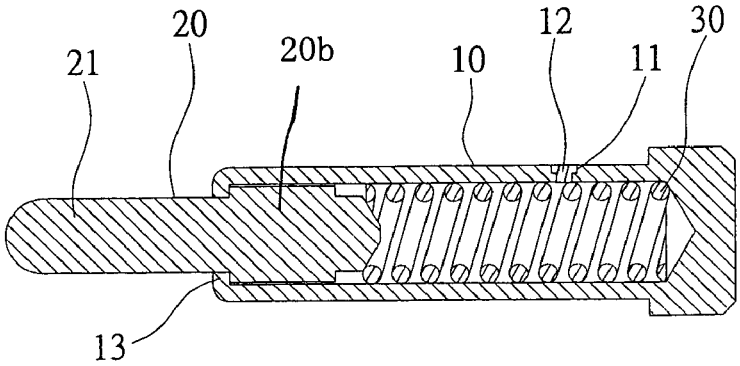
FIG. 5 is a cross-sectional view of FIG. 4 along the line 5—5.

Wherever possible in the following description, like reference numerals will refer to like elements and parts unless otherwise illustrated.

Referring to FIGS. 2–5, in one embodiment, a compressible pin assembly of the present invention includes a barrel 10, a contact pin 20 and an elastic element 30. The barrel 10 is integrally formed by a metallic material and has a hollow chamber. The barrel 10 has an open front end and a closed rear end. The rear end of the barrel 10 can be fastened into an aperture (not shown) previously formed on a printed circuit board, or can be soldered to a surface of a printed circuit board by means of surface mount technology (SMT) so that the barrel 10 can be electrically connected to the printed circuit board.

Figure 6:
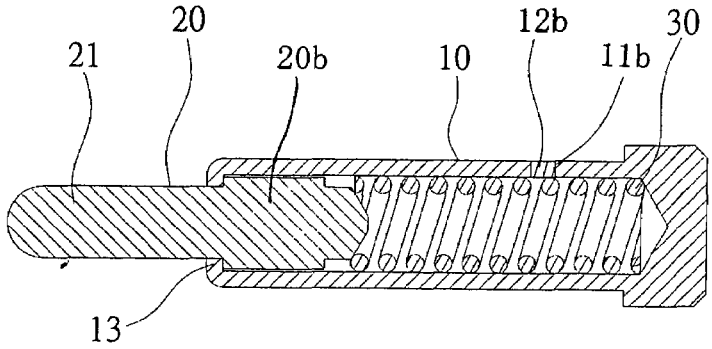
FIG. 6 is a cross-sectional view of the compressible pin assembly in accordance with a second embodiment of the present invention.
Figure 7:
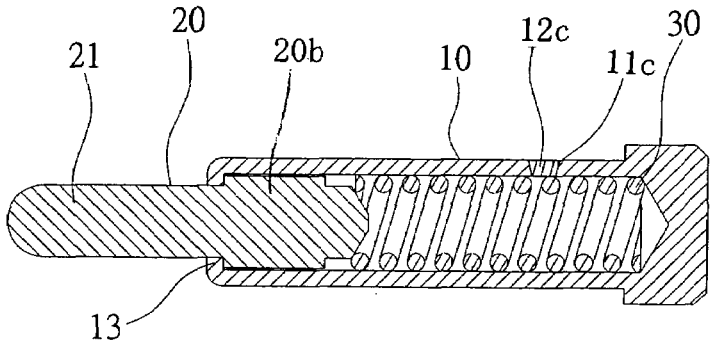
FIG. 7 is a cross-sectional view of the compressible pin assembly in accordance with a third embodiment of the present invention.
Figure 8:
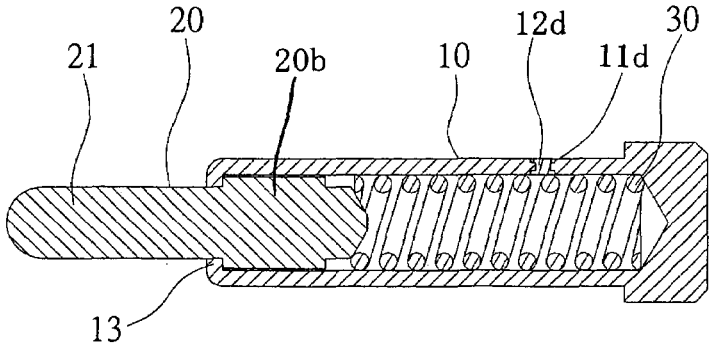
FIG. 8 is a cross-sectional view of the compressible pin assembly in accordance with a fourth embodiment of the present invention.
Figure 9:
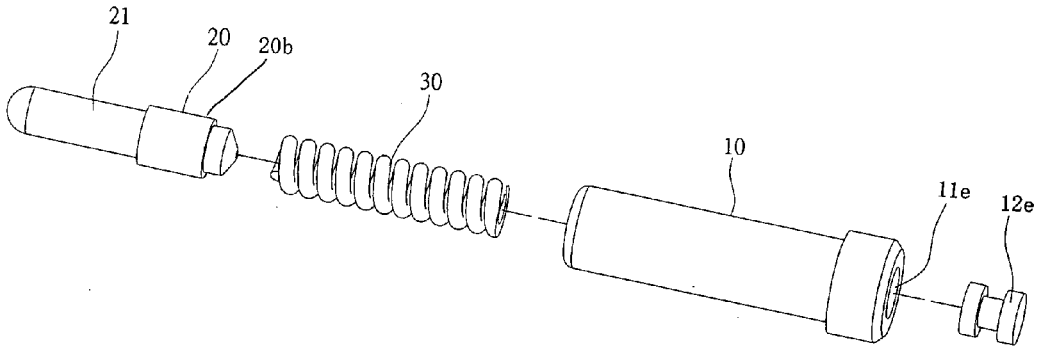
FIG. 9 is a perspective exploded view of the compressible pin assembly in accordance with a fifth embodiment of the present invention.
Figure 10:
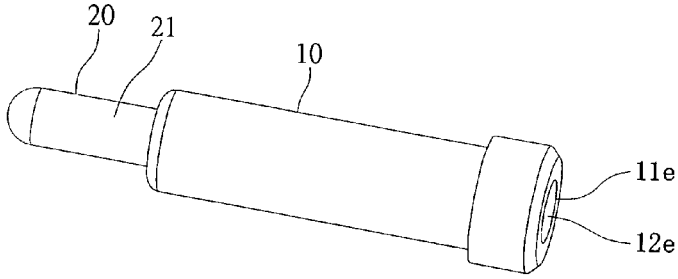
FIG. 10 is a perspective view of the compressible pin assembly in accordance with a fifth embodiment of the present invention.
Figure 11:
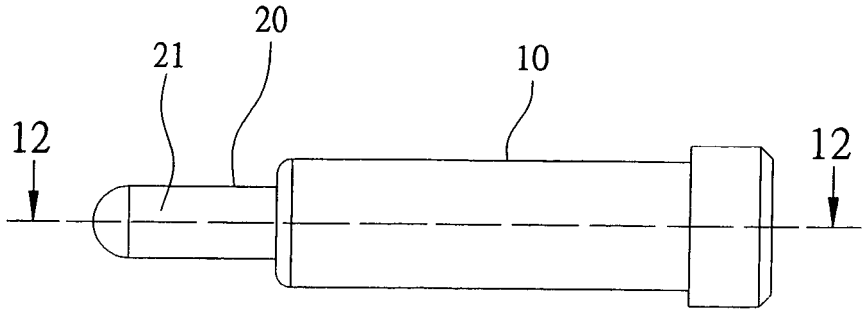
FIG. 11 is a plan view of the compressible pin assembly in accordance with a fifth embodiment of the present invention.
Figure 12:
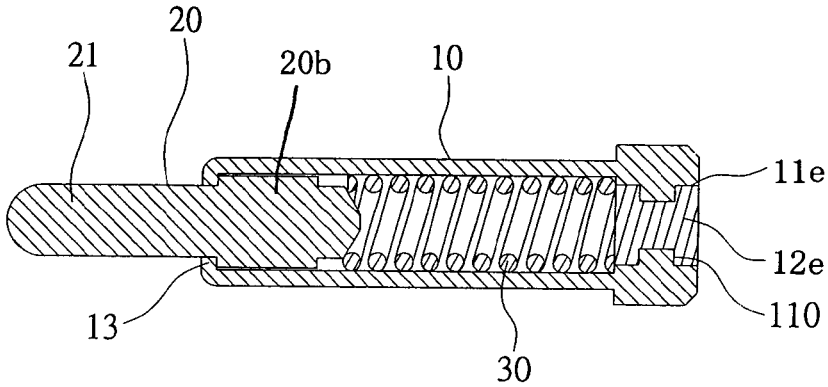
FIG. 12 is a cross-sectional view of FIG. 11 along the line 12—12.

In the preferred embodiment, the barrel 10 has an aperture 11 formed through the circumferential wall of the hollow chamber. The present invention provides a stopper 12 inserted into and sealing the aperture 11 after the barrel is in an immersion plating process. The aperture 11 and stopper 12 of the first embodiment have a T shape ( shown in FIGS. 2 and 5). The second embodiment (shown in FIG. 6) includes a cylindrical stopper 12*b* inserted into aperture 11*b*. The third embodiment (shown in FIG. 7) includes a semi-conical shaped stopper 12*c* with an aperture 11*c* having a beveled wall. The fourth embodiment (shown in FIG. 8) includes an I shaped stopper 12*d* which is insertable into a crimpable circular aperture 11*d* with walls corresponding to the I shaped cross section which confirms to the I shape of the stopper when the aperture is crimped about the stopper. The stopper 12, 12*b*, 12*c*, or 12*d* is fixed in the aperture 11, 11*b*, 11*c*, or 11*d*, respectively, by means of a press fit, rivet, or crimp arrangement to seal the aperture 11, 11*b*, 11*c*, and 11*d* after the barrel has been gold plated. The stopper will seal the aperture after the plating process preventing impurities from entering the hollow chamber of the barrel 10.

Figure 13:
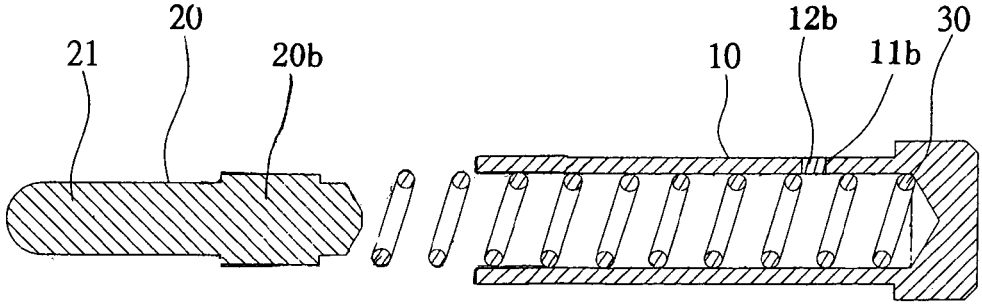
FIG. 13 is a cross-sectional semi exploded view of the compressible pin assembly in accordance with a second embodiment as shown in FIG. 6 but with the lip of the barrel uncrimped.

The contact pin 20 is made of a metallic material. The outer dimensions of the pin body 20*b* of the contact pin 20 is less than the inner dimensions of the barrel 10, allowing the pin body 20*b* to move within the hollow chamber of the barrel. The pin body 20*b* has outer dimensions, which can pass through an inwardly crimpable lip at the open front end of the barrel 10. FIG. 13 shows the contact pin 20 prior to it being inserted into the barrel 10. In this figure the barrel 10 has an uncrimped lip and an uncompressed elastic element 30. The lip in its uncrimped state has inner dimensions which are greater than the outer dimensions of the pin body 20*b* thereby allowing the pin body to be inserted into the hollow chamber.

The elastic element 30 is a compression spring arranged within the hollow chamber of the barrel 10 and positioned at a rear of the pin body 20*b*. The elastic element 30 and the pin body 20*b* are sequentially placed into the hollow chamber of the barrel 10 from the front end of the barrel 10. Then, the lip of the front end of the barrel 10 is crimped forming a reduced opening 13. This will prevent the pin body 20*b* from being removed from inside the hollow chamber. The contact end 21 of the contact pin 20 can pass through the reduced opening 13. The elastic element 30 pushes against the pin body 20*b* so that the contact end 21 is flexibly extended out the front end of the barrel 10.

FIGS. 9–12 disclose a fifth embodiment where the aperture 11*e* is formed on the closed rear end of the barrel 10 so that the barrel 10 has two openings, one formed on the front end and the other formed on the rear end to generate better flowing effects of the gold plating liquid. The barrel 10 of the present invention provides a flange 110 formed in the aperture 11*e* having an I shape. The stopper 12*e* is held in the aperture 11*e* after the flange 110 at the rear end of the barrel, which has been plated, is crimped over the stopper 12*e*.

There has thus been described a new, novel and heretofore unobvious compressible pin assembly which eliminates the aforesaid problems in the prior art. Furthermore, those skilled in the art will readily appreciate that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A compressible pin assembly comprising:

a barrel with a hollow chamber having a cross section with a first inner diameter, a closed end, and an open end, the open end forming a crimpable lip with an uncrimped second inner diameter larger than the first inner diameter of the hollow chamber and, when the lip is crimped radially inwardly, forming a crimped inner diameter;

a contact pin having a pin body with an outer diameter smaller than the first inner diameter of the cross section of the hollow chamber allowing for slidable movement of the pin body within the hollow chamber and having an outer diameter smaller than the uncrimped inner diameter of the crimpable lip so that the pin body can pass through the crimpable lip into the hollow chamber, the outer diameter being larger than the crimped inner diameter of the lip preventing movement of the pin body beyond the lip after the lip is crimped, the contact pin further having a contact end extending from the pin body through the lip of the open end of the barrel;

an elastic element contained in the hollow chamber against the closed end of the barrel to spring-bias the pin body of the contact pin against the lip so that the contact end of the pin body extends beyond the barrel;

an aperture passing through the hollow chamber of the barrel with a diameter less than the first inner diameter of the hollow chamber; and a stopper designed to be placed into and to seal the aperture.

2. The compressible pin assembly of claim 1 wherein the cross section of the hollow chamber of the barrel is circular.

3. The compressible pin assembly of claim 1 wherein the aperture is located in the closed end of the hollow chamber.

4. The compressible pin assembly of claim 3 wherein the stopper and aperture have an I shaped cross section where the aperture is crimped over the stopper.

5. The compressible pin assembly of claim 1 wherein the aperture is located in a circumferential wall of the hollow chamber.

6. The compressible pin assembly of claim 5 wherein the stopper is press fit in the aperture.

7. The compressible pin assembly of claim 6 wherein the stopper has a cylindrical outer wall and the aperture has a cylindrical inner wall.

8. The compressible pin assembly of claim 6 wherein the stopper has a semiconical outer wall and an aperture has a semi-conical inner edge.

* * * * *